US008839757B2

(12) United States Patent
Lawes

(10) Patent No.: US 8,839,757 B2
(45) Date of Patent: Sep. 23, 2014

(54) INTERNAL COMBUSTION ENGINE

(75) Inventor: Keith Lawes, Wimborne (GB)

(73) Assignee: RCV Engines Limited, Wimborne (GB)

( * ) Notice: Subject to any disclaimer, the term of this patent is extended or adjusted under 35 U.S.C. 154(b) by 80 days.

(21) Appl. No.: 13/201,194

(22) PCT Filed: Feb. 17, 2010

(86) PCT No.: PCT/GB2010/000284

§ 371 (c)(1),
(2), (4) Date: Aug. 11, 2011

(87) PCT Pub. No.: WO2010/094917

PCT Pub. Date: Aug. 26, 2010

(65) Prior Publication Data

US 2011/0308491 A1 Dec. 22, 2011

(30) Foreign Application Priority Data

Feb. 20, 2009 (GB) ..... 0902928.1

(51) Int. Cl.
*F01L 3/00* (2006.01)
*F01L 7/02* (2006.01)

(52) U.S. Cl.
CPC ..... *F01L 7/028* (2013.01)
USPC ..... 123/190.1; 123/190.12; 123/190.13; 123/190.4; 123/190.5; 123/190.6; 123/190.8; 123/190.9; 123/190.11; 123/190.14; 123/190.15; 123/190.16; 123/190.17

(58) Field of Classification Search
USPC ..... 123/190.1, 190.12, 190.13, 190.4, 123/190.5, 190.6, 190.8, 190.9, 190.11, 123/190.14, 190.15, 190.16, 190.17
See application file for complete search history.

(56) References Cited

U.S. PATENT DOCUMENTS

| | | | | | |
|---|---|---|---|---|---|
| 1,682,512 | A | * | 8/1928 | Hays | 123/80 R |
| 2,150,541 | A | * | 3/1939 | Chilton | 123/190.12 |
| 4,494,500 | A | * | 1/1985 | Hansen | 123/190.17 |
| 4,523,863 | A | * | 6/1985 | Okoshi | 384/609 |
| 5,095,870 | A | * | 3/1992 | Place et al. | 123/190.4 |
| 5,315,963 | A | * | 5/1994 | Warf | 123/190.12 |
| 5,490,485 | A | * | 2/1996 | Kutlucinar | 123/190.4 |
| 5,673,663 | A | * | 10/1997 | Kim | 123/190.4 |

(Continued)

FOREIGN PATENT DOCUMENTS

| | | |
|---|---|---|
| DE | 42 17 608 A1 | 4/1993 |
| EP | 0 194 041 A1 | 9/1986 |

(Continued)

OTHER PUBLICATIONS

International Search Report from PCT/GB2010/000284, mailed Jun. 4, 2010.

*Primary Examiner* — Lindsay Low
*Assistant Examiner* — Charles Brauch
(74) *Attorney, Agent, or Firm* — Thomas, Karceski & Karmilovich, PC

(57) ABSTRACT

A rotary valve internal combustion engine has a piston connected to a crankshaft and reciprocatable in a cylinder, a combustion chamber being defined in part by the piston, and a rotary valve rotatable in a valve housing fixed relative to the cylinder, the rotary valve having a valve body containing a volume defining, in part, the combustion chamber and further having a port giving, during rotation of the valve, fluid communication successively to and from the combustion chamber via inlet and exhaust ports.

17 Claims, 5 Drawing Sheets

(56) References Cited

U.S. PATENT DOCUMENTS

| | | | | |
|---|---|---|---|---|
| 6,346,215 | B1 * | 2/2002 | Boegel et al. | 420/470 |
| 2003/0226534 | A1 * | 12/2003 | Watanabe et al. | 123/90.17 |
| 2004/0099236 | A1 * | 5/2004 | Lee | 123/190.8 |
| 2004/0197581 | A1 * | 10/2004 | Berglund | 428/472 |
| 2008/0224418 | A1 * | 9/2008 | Lawes | 277/591 |
| 2009/0050089 | A1 * | 2/2009 | Lawes | 123/90.28 |

FOREIGN PATENT DOCUMENTS

| | | | |
|---|---|---|---|
| FR | 590 551 | A | 6/1925 |
| GB | 28797 | A | 2/1910 |
| JP | 01 163423 | A | 6/1989 |

* cited by examiner

INTERNAL COMBUSTION ENGINE

CROSS-REFERENCE TO RELATED APPLICATION(S)

This is a National Phase Entry, United States Non-Provisional Patent Application that relies for priority on International Patent Application No. PCT/GB2010/000284, filed on Feb. 17, 2010, and on Great Britain Patent Application No. 0902928.1, filed on Feb. 20, 2009, the contents of both of which are incorporated herein by reference.

FIELD OF THE INVENTION

The present invention relates to an internal combustion engine.

DESCRIPTION OF THE RELATED ART

One form of internal combustion engine is a rotatable cylinder valve (RCV) engine having a rotary cylinder including a valve port in communication with a combustion chamber, the cylinder being rotatable about its longitudinal axis in a cylindrical bore of a valve housing, the valve housing having an inlet port and an outlet port adapted to be aligned successively with said valve port during rotation of the cylinder in the housing to enable fluid to flow respectively into and out of the combustion chamber. Such rotating cylinder valve engines are known, for example from PCT/GB 01/04304 and PCT/GB 2003/002136. Such engines have a rotatable cylinder closed at one end to define, in part, a combustion chamber and an open end with a reciprocating piston disposed within the cylinder. The reciprocating piston is driven by a crankshaft. The crankshaft is coupled to the rotating cylinder via a 2:1 drive mechanism. This brings the valve port successively into alignment with the inlet port and outlet port in synchronism with the movement of the piston to form a conventional four stroke internal combustion engine.

Several different mechanisms have been used to rotate the cylinder valve from the crankshaft, the main design issue being the ability to cope with 90 degree change in the drive direction. Many designs have employed a bevel gear around the base of the cylinder. which engages with a half size gear on the crankshaft. This is convenient and compact, and works well for smaller engines, but for larger engines is expensive to produce and complex to adjust. It is also only suitable for single cylinder engines. For multi-cylinder and larger engines a drive system involving a 90 degree belt has been developed. This system drives the valve from the top of the engine. It is the adoption of a system that drives the valve from the top side that enables the improvements described in this patent to be implemented.

SUMMARY OF THE INVENTION

The main potential benefits of the RCV design over conventional poppet valve four stroke designs are as follows.

Firstly it offers a good combustion system with a compact combustion chamber which does not contain a hot exhaust valve. This makes it ideal for the operation of low octane fuels such as kerosene. Low octane fuels tend to detonate in conventional poppet valve engines which tend to have non-compact combustion chambers and hot exhaust valves.

Secondly it offers large valve breathing areas unimpeded by valve heads. This has been shown to produce engines with both good low speed torque and high speed power.

Thirdly it offers the potential for cost savings due to the reduced part count compared to a conventional poppet valve four stroke.

However there are three significant shortcomings of the rotary cylinder valve design which have become apparent.

Firstly the inherent problems of providing an adequate seal between the port formed in the rotating cylinder and the associated valve housing. Being adjacent to the combustion chamber, this part of the engine is subjected to large thermal stresses, high gas pressures and high surface speeds with little or no lubrication. In order to reduce leakage between the rotating cylinder valve and the fixed valve housing, the conventional practice has been to provide as small a gap as possible. However because of the differential thermal expansion between the valve inner and the valve housing, and the high temperatures that the valve inner reaches because of its thermal isolation, if the gap is made small enough to limit leakage to acceptable levels, the engines are prone to seizing. In the past, this has resulted in a strict size limitation in the diameter of the valve in order to prevent seizing. As the diameter of the valve dictates the size of the port, the diameter limit in turn limits the breathing of the engine and thus its practical cylinder capacity. In order to achieve acceptable reliability, such engines in the past have been limited to valves of typically 14-17 mm valve diameter. This limits the practical cylinder capacity to 10-20 cc. Engines such as these are used successfully in model aircraft. With existing technology and materials, it is not possible to achieve acceptable reliability for valves greater than 23 mm diameter which limits the cylinder capacity to around 30 cc. More complex sealing systems have been devised which get around this tolerancing problem and enable larger diameter valves to be employed. These have been demonstrated to work, but these are generally too complex to be fitted to smaller capacity engines.

Secondly the inherent thermal problems of having a thermally isolated rotating cylinder. The thermal break between the rotating cylinder and the cylinder jacket means the thermal conductivity between the rotating cylinder and cooling fins on the cylinder jacket is very poor, which leads to high operating temperatures on the rotating cylinder and valve inner. This exacerbates the sealing and reliability problems of the plain valve. This problem becomes significantly worse as the cylinder capacity increases. Direct oil cooling of the rotating cylinder has been successfully employed on larger designs, but this is complex, heavy, and not applicable to smaller capacities.

Thirdly the cost of the RCV components. Whilst the component count of the RCV is much lower than a conventional poppet valve, the rotating cylinder valve is a large and comparatively complex component, and has to be fitted with a large lower ball race. These two considerations mean that it is hard to actually achieve a cost benefit compared to a conventional design.

The present invention seeks to preserve the chief benefits of the RCV concept, that is heavy fuel operation, high performance, and potential low cost, whilst providing solutions to the problems of sealing, poor thermal conductivity and high component cost. This is achieved by splitting the rotating valve portion of the RCV from the cylinder, fixing the cylinder and only rotating the valve. This preserves the basic combustion technology of the RCV whilst improving its thermal and sealing performance.

Fixing the cylinder and rotating the valve part only has four main benefits.

Firstly it improves the cooling of the engine as it allows the cylinder to be directly thermally coupled to the cooling fins.

Secondly it improves the sealing performance of the valve. This is because the design is inherently an active seal. An active seal is one where the combustion pressure forces the sealing surfaces together improving the seal. On the rotary valve design the fact that the valve can rock slightly in its top bearing means that the combustion pressure forces the valve back against the exhaust and inlet ports, tending to seal the leak path up to these ports.

Thirdly it enables a change to be made in the rotary valve design which both improves the sealing and thermal performance of the valve. On the RCV design the lip immediately below the valve port has always been the most unreliable part and thermally stressed part of the valve design. This is because it is extensively exposed to the combustion exhaust gas and has only a very small thermal path leading away from it. On the present invention design it no longer has a sealing function as it has combustion gas both above and below it. This means that, in preferred embodiments of the invention, this part of the valve can be deleted from the design with no effect on the sealing. The elimination of the lip also gives greater flexibility for the design of the combustion chamber in the rotary valve.

Fourthly it reduces component cost. The cylinder becomes conventional in design and manufacture. The rotary valve is a much smaller and cheaper component than the previous rotary cylinder and does not require an expensive lower bearing.

An additional benefit of the present invention is that the rotary valve no longer needs to be aligned with the axis of the cylinder. This means the valve can be moved to a position and angle where it no longer needs a right angled cylinder drive. It also opens up alternative positions for the spark plug and cylinder heaters.

According to the present invention there is provided a rotary valve internal combustion engine having a piston connected to a crankshaft and reciprocatable in a cylinder, a combustion chamber being defined in part by the piston, and a rotary valve rotatable in a valve housing fixed relative to the cylinder, the rotary valve having a valve body containing a volume defining, in part, the combustion chamber and further having in a wall part thereof a port giving, during rotation of the valve, fluid communication successively to and from the combustion chamber via inlet and exhaust ports in the valve housing, wherein the port in the valve is a recess formed in the lower peripheral edge of the wall of the valve body adjacent to the combustion chamber the recess extending upwardly from this lower edge of the wall of the valve to form the port in the side of the valve.

In this embodiment there is no lower lip to the port in the valve. In this embodiment the recess in the valve may be substantially offset from the axis of rotation of the valve.

According to another aspect of the invention there is provided a rotary valve internal combustion engine having a piston connected to a crankshaft and reciprocatable in a cylinder, a combustion chamber being defined in part by the piston, and a rotary valve rotatable in a valve housing fixed relative to the cylinder, the rotary valve having a valve body containing a volume defining, in part, the combustion chamber and further having in a wall part thereof a port giving, during rotation of the valve, fluid communication successively to and from the combustion chamber via inlet and exhaust ports in the valve housing, in which the port in the valve is a bore in the wall part of the valve body, the wall having a lip formed below the port adjacent to the combustion chamber wherein the surface of the lip is spaced back from the profile of the wall periphery to allow clearance between the lip and the valve housing to minimise the risk of seizures or wear occurring within this region of the valve.

Preferably the valve body is mounted for rotation in the valve housing in a single ball race above the valve, located remote from the combustion chamber, said bearing taking the combustion pressure force that is exerted upon the underside of the valve whilst providing the small amount of play necessary for the valve to move within its bore to close off the potential leak path between combustion chamber and inlet and exhaust ports.

According to another aspect of the present invention there is provided a heatsink which is attached directly to and rotates with the valve, said heatsink providing direct thermal cooling of the valve.

Preferably said heatsink comprises one or more cooling fins secured to the rotary valve for rotation therewith.

Alternatively said heatsink may take the form of a fan which both directly conducts heat away from the valve and blows cooling air over the cylinder.

Preferably the rotary valve is rotated by a drive system which transmits the drive to the valve by a gear or pulley secured to the valve remote from and above the combustion chamber.

Preferably the rotary valve is driven from the crankshaft by means of a belt.

Preferably the belt comprises a one-piece endless belt.

In a preferred embodiment of the invention the axis of rotation of the valve is coaxial with the axis of the cylinder.

In a second preferred embodiment of the invention the axis of rotation of the rotary valve is parallel to but offset relative to the axis of the cylinder, Preferably in either of these embodiments the valve is driven by a toothed belt driven from the crankshaft, the belt being deflected by approximately 90° by a system of idlers.

A third preferred embodiment where the axis of rotation of the rotary valve is at an angle to the axis of the cylinder.

Preferably in this embodiment the valve is driven by a toothed belt driven from the crankshaft, the belt is deflected at the necessary angle by a system of idlers.

In a preferred embodiment of the valve the axis of rotation of the rotary valve is at right angles to the axis of the cylinder.

In this embodiment a straight toothed belt valve drive may be employed to drive the valve from the crankshaft.

Alternatively in this embodiment, a conventional chain drive may be employed to drive the valve from the crankshaft.

Preferably the external diameter of the uniform profile part of the rotary valve is substantially smaller than the diameter of the cylinder.

Preferably the diameter of the cylinder is approximately twice that of the uniform profile diameter.

In a preferred embodiment the engine is a spark ignition engine.

In this embodiment the engine may run on gasoline or on a heavy fuel such as kerosene or diesel.

In a preferred embodiment the engine is a compression ignition engine.

In this embodiment the engine will run on a heavy fuel such as kerosene or diesel.

In preferred embodiments, the engine has direct fuel injection and spark ignition.

In this embodiment the engine may run on gasoline or on a heavy fuel such as kerosene or diesel.

In a preferred embodiment the rotary valve body is formed of a steel which has been plasma nitrided and then ground into its final size.

In this embodiment the rotary valve body may be provided with a PVD coating, which may be a DLC (Diamond Like Carbon) coating.

Alternatively in this embodiment the PVD coating may be a ceramic coating.

In a preferred embodiment the bore in the valve housing is formed of a copper-based alloy with a high tin content.

BRIEF DESCRIPTION OF THE DRAWINGS

Preferred embodiments of the invention will now be described by way of example with reference to the accompanying drawings, in which:—

DETAILED DESCRIPTION OF EMBODIMENT(S) OF THE INVENTION

Figure 3:
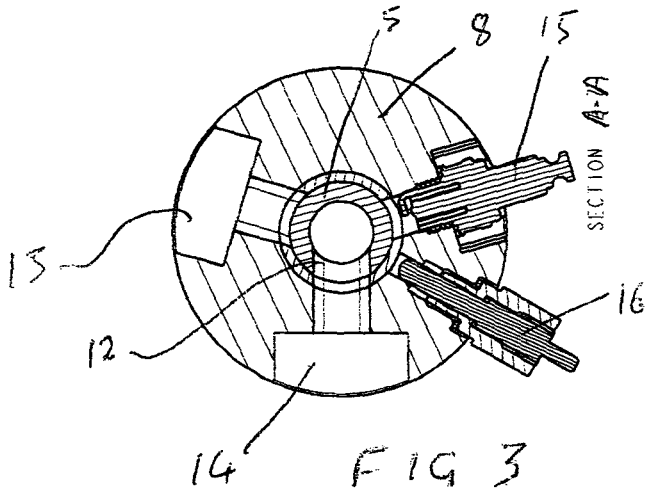
FIG. 3 shows a cross-sectional view along the line A-A of FIG. 1, FIGS. 4*a* and 4*b* show two embodiments of a rotary valve body.
Figure 1:
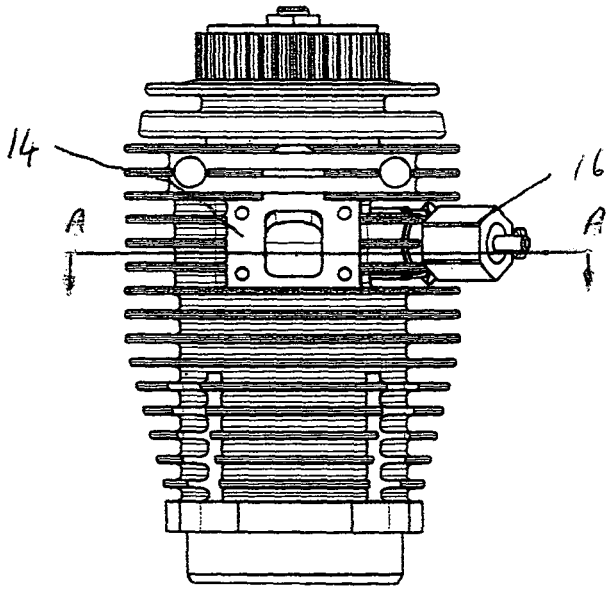
FIG. 1 shows a side view of a single cylinder reciprocating piston internal combustion engine.
Figure 2:
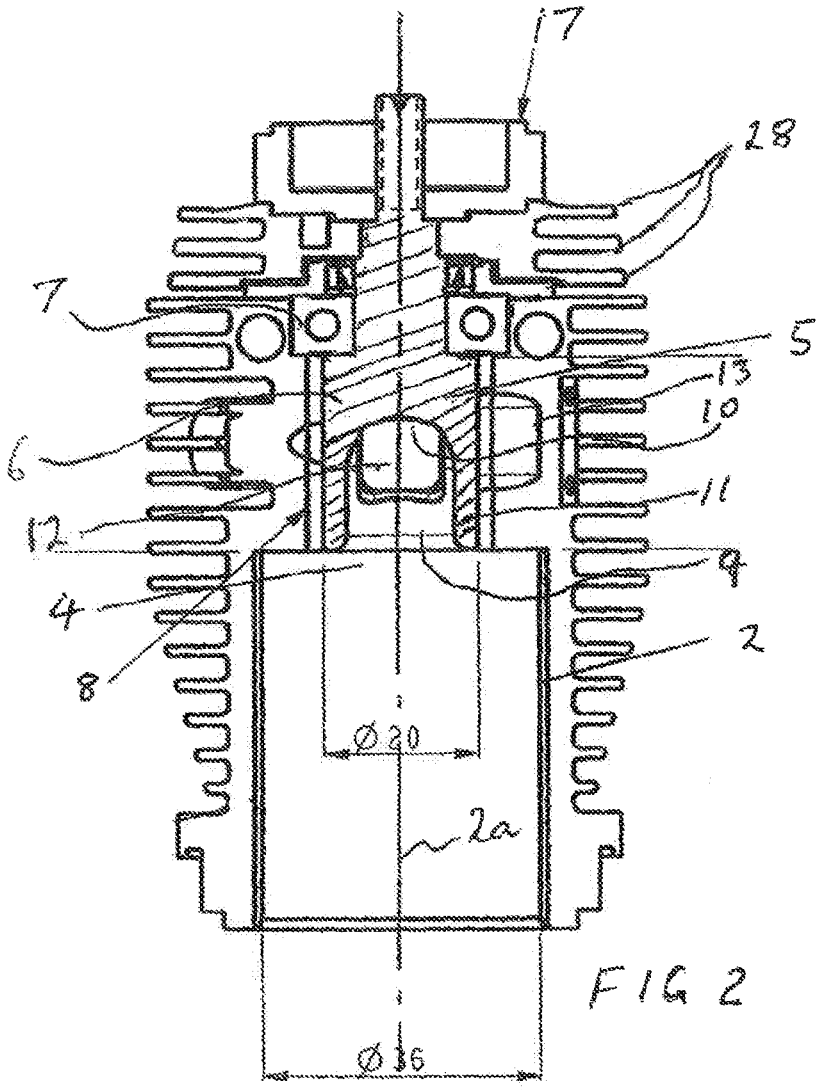
FIG. 2 shows a longitudinal cross-sectional view of the engine of FIG. 1.
Figure 5:
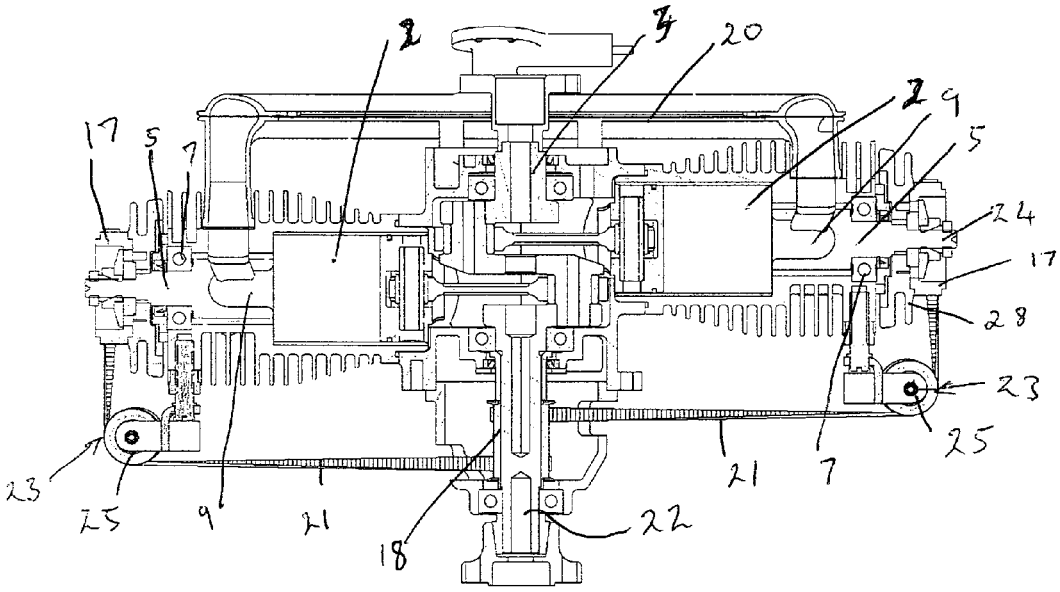
FIG. 5 shows a cross-sectional view of a horizontally opposed twin cylinder rotary valve engine.
Figure 6:
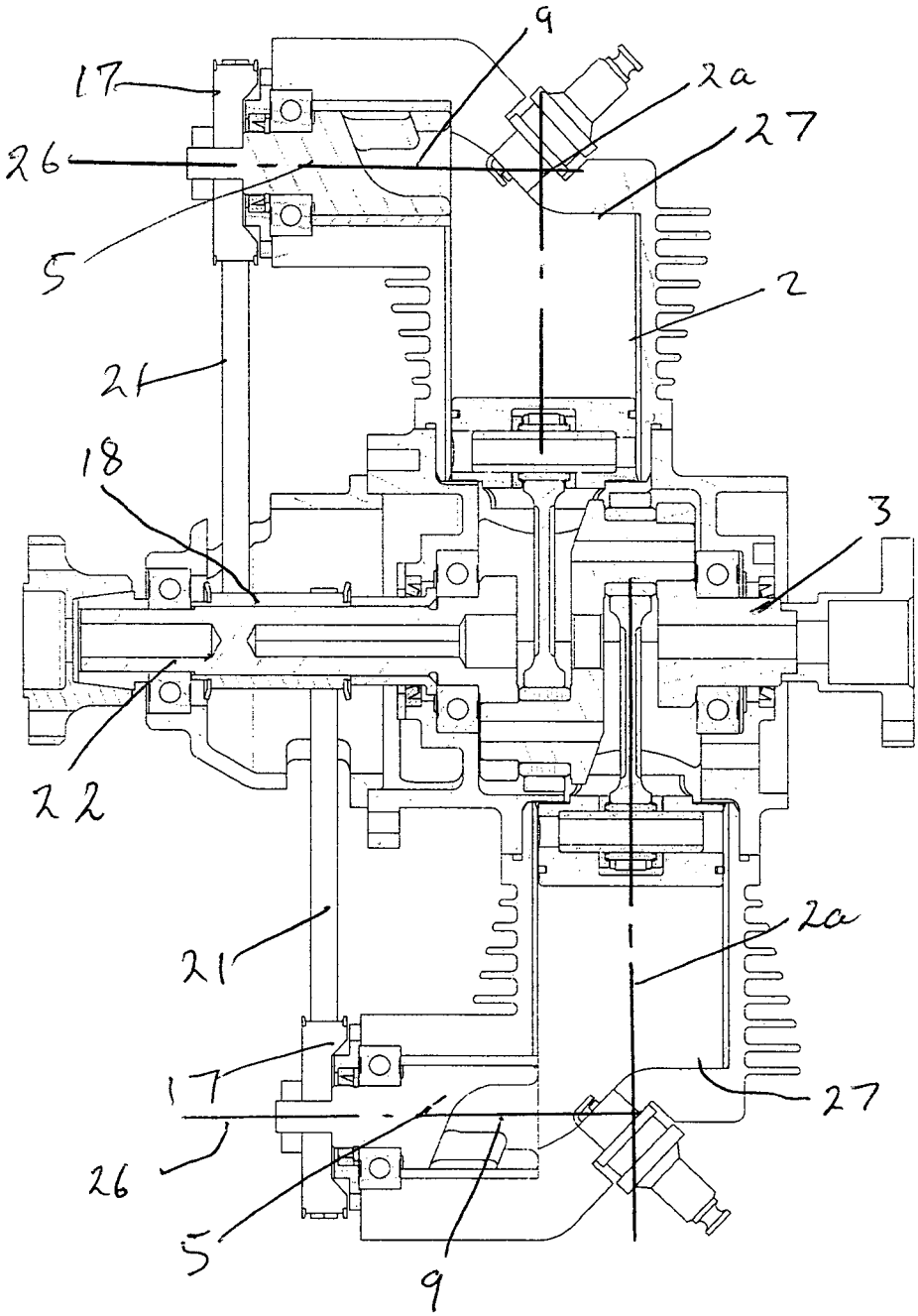
FIG. 6 shows an alternative embodiment of horizontally opposed twin cylinder rotary valve engine.

Referring to the drawings, FIGS. 1, 2 and 3 illustrate a single cylinder air cooled engine and FIGS. 5 and 6 illustrate a horizontally opposed twin cylinder engine. The cylinders 2 each having a piston 1 (FIGS. 5 and 6) connected to a crankshaft 3 in the conventional manner for reciprocation in the cylinder 2. As shown particularly in FIG. 2, the upper part of the cylinder 2 is closed to form a combustion chamber 4. The flow of inlet air and exhaust gas into and out of the combustion chamber 4 is controlled by a rotary valve 5, shown in cross-section in FIG. 2. In this embodiment, the valve is rotatable about the axis 2*a* of the cylinder 2.

The rotary valve consists of a first cylindrical part 6 mounted on a ball bearing 7, located on a side of the valve 5 remote from the combustion chamber 4 for rotation in a bore in a valve housing 8 in which the cylindrical part 6 of the valve 5 is a close sliding fit, with only a minimum clearance provided between the rotary valve 5 and the bore of the valve housing 8. The bore in the valve housing 8 is formed a copper-based alloy with a high tin content. The rotary valve 5 has in its interior a volume 9, as illustrated in FIG. 2, which forms part of the combustion chamber 4 and which consists of a closed substantially hemispherical upper end 10 and a substantially cylindrical downwardly extending wall part 11 extending downwardly towards the piston. The wall part 11 has a port 12 giving fluid access to and from the combustion chamber 4 through inlet and exhaust ports 13, 14 in the valve housing 8, illustrated particularly in the cross-section of FIG. 3. FIG. 3 also illustrates a spark plug 15 and a glow plug 16 although these components are not provided in all engines constructed in accordance with the invention. The rotary valve body is formed of a steel, such as EN40B, which has been plasma nitrided and then ground into its final size, before being provided with a PVD coating such as a DLC (Diamond like Carbon) coating or a PVD ceramic coating. The diameter of the valve body is less than 25 mm and the cylinder is approximate twice the diameter of the valve body.

At its end remote from the combustion chamber 4, the rotary valve 5 has a driven pulley 17 mounted thereon which is connected to a drive pulley 18 on the engine crankshaft 3 by a belt drive arrangement 19, to be described later. Thus, the rotary movement of the crankshaft 3 and hence the piston movement is coordinated with the rotation of the rotary valve 5 so that the engine operates on the conventional four stroke cycle. To achieve this, the diameter of the driven pulley 17 is twice that of the drive pulley 18 so that the rotary valve 5 rotates at half engine speed. In addition, cooling fins 28 are also secured to the rotary valve 5 for rotation therewith in order to provide additional cooling for the valve and valve housing.

Figure 4A:
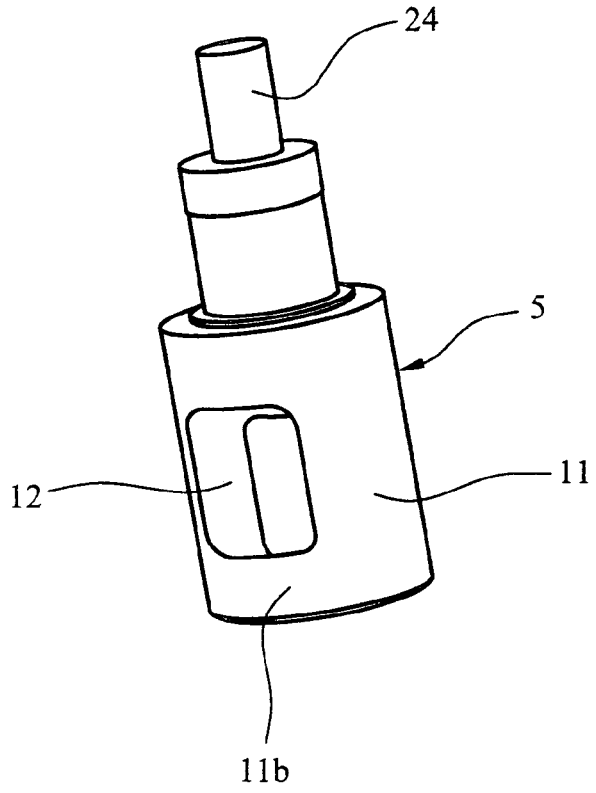
Figure 4B:
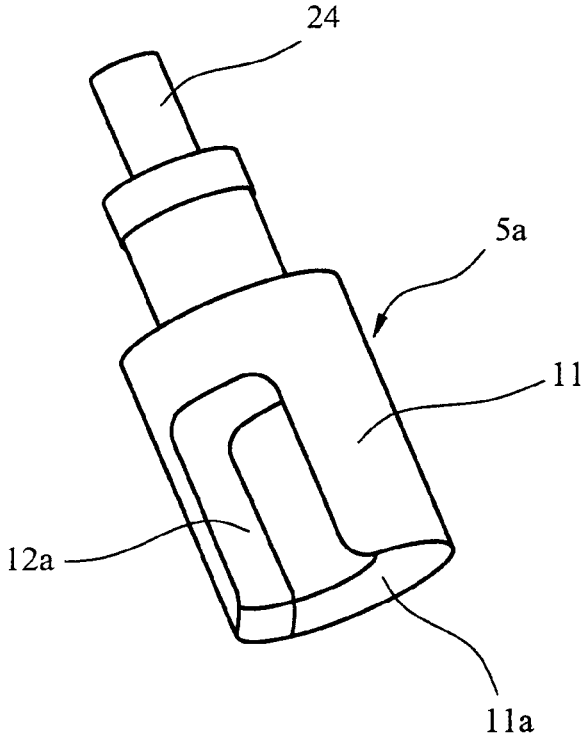

Referring now to FIGS. 4*a* and 4*b*, there is illustrated two forms of the rotary valve 5. In FIG. 4*a*, there is shown the rotary valve 5 illustrated in FIG. 2 in which the port 12 in the cylindrical wall 11 of the rotary valve 5 is a bore or hole cut in the wall 11. FIG. 4*b* illustrates an alternative form of the valve 5*a* in which the port 12*a* consists of a recess cut upwardly from the lower edge 11*a* of the cylindrical wall 11. This version of the port 12*a* has certain advantages in that the concentration of heat which builds up in the relatively narrow peripheral part or lip 11*b* of the wall below the port 12 in FIG. 4*a* is eliminated.

Although this embodiment is shown with the interior volume 9 being, in cross-section, a uniform profile about the axis of rotation 2*a* of the valve, in alternative constructions the volume may be non-uniform about the axis of rotation and can be offset in the cylindrical part relative to the axis of rotation and may also be of non-cylindrical shape such as part conical or rectangular with rounded corners. The precise shape of the volume will depend upon the combustion characteristics required for the engine and the fuel used, the compression ratio required and the flow characteristics required. In an alternative embodiment of the invention having a lip below the port, the surface of this lower lip 11*b* is spaced back from the profile of the wall periphery, that is it has a slightly smaller radius, to allow significant clearance between the lip and the valve housing to minimise the risk of seizures or wear occurring within this region of the valve.

Referring now to FIG. 5, there is shown a cross-sectional view of a horizontally opposed flat twin form of engine with a rotary valve 5 particularly as described with reference to FIG. 2 for each cylinder. This view of the engine illustrates the inlet port 20 leading to the rotary valves 5, the exhaust port not being shown. The drawing also illustrates the belt drive arrangement in which, for each rotary valve 5, a single endless loop belt 21 deflected through 90° is provided driven from the crankshaft.

The drive pulley 18 is mounted on an extension 22 of the crankshaft 3 and has two belt engaging surfaces, one for each drive belt 21. As described earlier, the driven pulley 17 for receiving the belt 21 is secured to the outer end shaft 24 of the rotary valve 5 and the belt is deflected through 90° by a guide pulley arrangement 23 mounted on the main housing of the engine. As illustrated in this cross-section, only one run of the belt 21 is shown but it will be understood that the pulley arrangement consists of a diverter pulley 25 for each run of the belt.

The rotary valve 5 has to be driven at half engine speed to provide the four stroke cycle and to this end, the pulley 17 attached to the rotary valve 5 has twice the diameter of the pulley 18 on the crankshaft 3. The driven pulley 17 incorporates fan blades to generate an airflow during rotation of the valve 5 over the remainder of the valve body and valve housing 8 to assist cooling. Heat dissipation fan blades are also secured to the rotary valve 5 for rotation with the valve to improve the cooling of the valve.

Referring now to FIG. 6 is shown an alternative embodiment of horizontally opposed flat twin engine in which the rotary valve 5 in both cases is located with its axis of rotation 26 at right angles to the axis 2 of the cylinder. The interior volume 9 of the rotary valve in this embodiment is non-uniform about its axis of rotation 26 to provide the required shape to the overall combustion chamber 4. In this embodiment, a squish area 27 is formed between the piston and the valve housing 8 on the side of the cylinder 3 opposite the valve 5 and a wedge shape volume is provided for part of the combustion chamber 4 between the squish area and the valve.

As shown, the axis of rotation 26 of the rotary valve intersects the axis 2*a* of the cylinder 2 but it could be offset from this cylinder axis 2*a* to give swirl flow characteristics to the inlet air. In an alternative form (not illustrated), the rotary valve is inclined at an angle, such as 30°, to the axis of the cylinder to facilitate the provision of a wedge shape for the main part of the combustion chamber. In such a configuration, the belt drive would be in a similar form to that shown in the embodiment of FIG. 5 although the belt runs would need to be diverted only by 30° rather than 90° as shown in FIG. 5.

In the embodiment of FIG. 6, the belt drive 22 to each rotary valve lies in a single plane. The arrangement includes a drive pulley 18 secured for rotation on an extension of the crankshaft, this pulley having two belt engaging surfaces, one for each of the belts. The spacing of the belts 21 on the pulley 18 is substantially identical to the spacing between the axes 2*a* of the two cylinders 2 to enable identical parts to be used for the belt drive arrangements and the valve housings 8. As described with reference to the embodiment of FIG. 5, a driven pulley 17 is secured for rotation on the outer end shaft 24 of each valve 5, the pulley being twice the diameter of the drive pulley 18 on the crankshaft 3 and including radially disposed fan blades for directing a cooling flow of air over the valve 5 and valve housing 8.

The engine may be a conventional spark ignition engine but equally could be a compression ignition diesel engine or multi fuel engine. Fuel can be supplied either through a carburettor or fuel injection, which may be direct fuel injection.

The invention claimed is:

1. A rotary valve internal combustion engine, comprising:
- a crankshaft;
- a cylinder;
- a piston connected to the crankshaft, wherein the piston is reciprocatable in the cylinder;
- a combustion chamber being defined in part by the piston, in the cylinder;
- a valve housing fixed relative to the cylinder, the valve housing defining a valve bore;
- a rotary valve disposed in the valve bore, wherein the rotary valve comprises
  - a valve body containing a volume defining, in part, the combustion chamber
  - a wall part defining a lower peripheral edge, and
  - a port in the wall part, wherein
    - the port is a recess formed through the wall part that extends upwardly from the lower peripheral edge, and
    - during rotation of the valve body, the port provides fluid communication successively to and from the combustion chamber;
- inlet and exhaust ports in the valve housing, wherein the inlet and exhaust ports cooperate with the port to provide fluid communication successively to and from the combustion chamber during rotation of the valve body;
- a bearing arrangement rotationally supporting the rotary valve, wherein the bearing arrangement comprises a single ball-race, located remote from the combustion chamber, and wherein the bearing arrangement is an active seal so that, while being subjected to combustion pressure forces, provides an amount of play permitting the rotary valve to rock within the valve bore to reduce a leakage path between the combustion chamber and the inlet and exhaust ports; and
- an endless belt connected between the crankshaft and the rotary valve for driving the rotary valve.

2. A rotary valve internal combustion engine, comprising:
- a crankshaft;
- a cylinder;
- a piston connected to the crankshaft, wherein the piston is reciprocatable in the cylinder;
- a combustion chamber being defined in part by the piston, in the cylinder;
- a valve housing fixed relative to the cylinder, the valve housing defining a valve bore;
- a rotary valve disposed in the valve bore, wherein the rotary valve comprises
  - a valve body containing a volume defining, in part, the combustion chamber,
  - a wall part defining a lower peripheral edge,
  - a port in the wall part, wherein
    - the port is a bore formed through the wall part, and
    - during rotation of the valve body, the port provides fluid communication successively to and from the combustion chamber, and
  - a lip formed by the wall part between the lower peripheral edge and the port, wherein the lip is spaced back from the profile of the wall periphery to allow clearance between the lip and the valve housing to minimize at least one of seizures or wear between the valve housing and the lip;
- inlet and exhaust ports in the valve housing, wherein the inlet and exhaust ports cooperate with the port to provide fluid communication successively to and from the combustion chamber during rotation of the valve body;
- a bearing arrangement rotationally supporting the rotary valve, wherein the bearing arrangement comprises a single ball-race, located remote from the combustion chamber, and wherein the bearing arrangement is an active seal so that, while being subjected to combustion pressure forces, provides an amount of play permitting the rotary valve to rock within the valve bore to reduce a leakage path between the combustion chamber and the inlet and exhaust ports; and
- an endless belt connected between the crankshaft and the rotary valve for driving the rotary valve.

3. An engine according to claim 1 or 2, wherein the volume has a substantially hemispherical closed end adjoining the wall part of the rotary valve, has a uniform profile about an axis of rotation, and is open to a remainder of the combustion chamber.

4. An engine according to claim 1 or 2, wherein an outer surface of the wall part is substantially cylindrical.

5. An engine according to claim 1 or 2, wherein:
- an axis of rotation of the rotary valve is at right angles to an axis of the cylinder and
- the axis of rotation of the rotary valve is parallel to the crankshaft.

6. An engine according to claim 5, further comprising:
- a pulley secured to the rotary vale on a side remote from the combustion chamber,
- wherein the endless belt drives the rotary valve through the pulley.

7. An engine according to claim 1 or 2, wherein the endless belt is an endless chain.

8. An engine according to claim 1 or 2, wherein the rotary valve body is formed of steel, which has been plasma nitrided and then ground into a final size, before being provided with a PVD coating.

9. An engine according to claim 1 or 2, wherein the valve bore in the valve housing is formed of a copper-based alloy with a high tin content.

10. An engine according to claim 1 or 2, wherein the rotary valve includes a heat sink.

11. An engine according to claim 1 or 2, wherein an axis of rotation of the rotary valve is at least one of co-axial with an axis of the cylinder, parallel to but offset relative to the axis of the cylinder, or at an acute angle to the axis of the cylinder.

12. An engine according to claim 7, further comprising:

a gear secured to the rotary valve on a side remote from the combustion chamber, wherein the endless chain drives the rotary valve through the gear.

13. An engine according to claim 1 or 2, further comprising:

a pulley secured to the rotary valve on a side remote from the combustion chamber, wherein the endless belt drives the rotary valve through the pulley.

14. An engine according to claim 13, wherein:

the rotary valve further comprises an outer end shaft at an end opposite to the wall part, the bearing arrangement is disposed along an axis of rotation of the rotary valve between the wall part and the outer end shaft, and the pulley is disposed on the outer end shaft.

15. An engine according to claim 12, wherein:

the rotary valve further comprises an outer end shaft at an end opposite to the wall part, the bearing arrangement is disposed along an axis of rotation of the rotary valve between the wall part and the outer end shaft, and the gear is disposed on the outer end shaft.

16. An engine according to claim 14, wherein the bearing arrangement is the only bearing facilitating rotation of the rotary valve.

17. An engine according to claim 15, wherein the bearing arrangement is the only bearing facilitating rotation of the rotary valve.

* * * * *